US007562749B2

(12) United States Patent
Race, Sr. et al.

(10) Patent No.: US 7,562,749 B2
(45) Date of Patent: Jul. 21, 2009

(54) ROLLER GUIDE

(75) Inventors: Timothy Theodore Race, Sr., Spring Grove, PA (US); Richard Alan Ruskey, Baltimore, MD (US); William Paul Sturm, III, Centerville, MD (US)

(73) Assignee: Elevator Safety Company, Owings Mills, MD (US)

( * ) Notice: Subject to any disclaimer, the term of this patent is extended or adjusted under 35 U.S.C. 154(b) by 655 days.

(21) Appl. No.: 10/837,608

(22) Filed: May 4, 2004

(65) Prior Publication Data

US 2005/0279585 A1 Dec. 22, 2005

(51) Int. Cl.
*B66B 7/04* (2006.01)

(52) U.S. Cl. ..... 187/410; 187/409

(58) Field of Classification Search ..... 187/250, 187/409, 410

See application file for complete search history.

(56) References Cited

U.S. PATENT DOCUMENTS

| | | | | | |
|---|---|---|---|---|---|
| 1,713,165 | A | | 5/1929 | Bridge | |
| 1,854,976 | A | * | 4/1932 | Brady | 187/406 |
| 2,083,502 | A | | 6/1937 | Matthews | |
| 2,100,169 | A | | 11/1937 | Norton | |
| 2,251,963 | A | | 8/1941 | Spiro | |
| 2,253,820 | A | | 8/1941 | Spiro | |
| 2,265,086 | A | | 12/1941 | Spiro | |
| 2,309,123 | A | | 1/1943 | Kiesling | |
| 2,498,299 | A | * | 2/1950 | Rissler | 187/406 |
| 3,087,583 | A | * | 4/1963 | Bruns | 187/406 |
| 3,099,334 | A | * | 7/1963 | Tucker, Jr. | 187/406 |
| 3,329,240 | A | | 7/1967 | Harwood | |
| 3,669,222 | A | * | 6/1972 | Takamura et al. | 187/410 |
| 3,856,117 | A | | 12/1974 | Solymos | |
| 4,434,876 | A | * | 3/1984 | McKechnie | 187/410 |
| 4,540,964 | A | * | 9/1985 | Bleeke | 335/205 |
| 4,793,441 | A | | 12/1988 | Cilderman | |
| 5,033,589 | A | | 7/1991 | Rhodes | |
| 5,107,963 | A | | 4/1992 | Rocca | |
| 5,117,946 | A | | 6/1992 | Traktovenko | |
| 5,535,853 | A | | 7/1996 | Skalski | |
| 5,632,358 | A | * | 5/1997 | Maeda et al. | 187/410 |
| 5,950,771 | A | * | 9/1999 | Ferrisi et al. | 187/411 |
| 5,960,911 | A | | 10/1999 | Guaita | |
| 5,984,053 | A | | 11/1999 | Lee | |

(Continued)

OTHER PUBLICATIONS

"Rosta Technology", nineteen pages, publication date not known but isbelieved to have been publicly available more than one year prior to the filing date of the subject patentapplication.

(Continued)

*Primary Examiner*—Peter M Cuomo
*Assistant Examiner*—Eric Pico
(74) *Attorney, Agent, or Firm*—Merek, Blackmon & Voorhees, LLC

(57) ABSTRACT

A roller guide for guiding the movement of an elevator car along guide rails disposed in a shaft or hoistway. The roller guide includes a base, a plurality of rollers and a plurality of support arms that rotatably support the rollers. An isolation assembly may be provided to reduce the transmission of undesired forces to the elevator car through the rollers, support arms and the base of the roller guide.

21 Claims, 4 Drawing Sheets

U.S. PATENT DOCUMENTS

| | | | | |
|---|---|---|---|---|
| 6,032,764 | A * | 3/2000 | Ferrisi et al. | 187/410 |
| 6,050,370 | A * | 4/2000 | Jung | 187/410 |
| 6,062,347 | A * | 5/2000 | Traktovenko | 187/410 |
| 6,786,304 | B2 * | 9/2004 | Utsunomiya et al. | 187/292 |
| 2005/0007005 | A1 * | 1/2005 | Jung | 313/477 R |

OTHER PUBLICATIONS

Web excerpt from Assignee's web page on prior art "Express High Speed Roller Guides".
Web excerpt from Assignee's web page on prior art "Model A High Speed Roller Guides".
Web excerpt from Assignee's web page on priod art "Model B Moderate Speed Roller Guides".
Web excerpt from Assignee's web page on prior art "Model C Roller Guides".
Web excerpt from Assignee's web page on prior art "Express D Roller Guides".
Web excerpt from Assignee's web page on prior art "Model E Roller Guides".
ACLA USA, Inc. product catalog believed to have been published more than one year prior to filing date of subject patent application.
Hollister-Whitney product (HW91-5M) catalog believed to have been published more thanone year prior to filing date of subject patent application.
Hollister-Whitney product (HW94-1) catalog believed to have been published more than one year prior to filing date of subject patent application.
EleComp brochure believed to have been published more than one year prior to filing date of subject patent application.
ELPRO product catalog believed to have been published more than one year prior to filing date of subject patent application.
Excerpt from web page of ThyssenKrupp Northern Elevator.
Excerpt from web page of Otis Elevator Company.
Excerpt from web page of KD Associates, Inc.
Delco Industries, Ltd. brochure believed to have been published more than one year prior to filing date of subject patent application.

* cited by examiner

ROLLER GUIDE

FIELD OF THE INVENTION

The present invention is directed to roller guides used for guiding the movement of an elevator car along guide rails installed in a shaft or hoistway.

BACKGROUND OF THE INVENTION

Typically, an elevator car travels along a pair of opposing guide rails located in a shaft or hoistway. It is customary to employ four roller guides per elevator car to guide the elevator car along the guide rails as the car is moved in a shaft or hoist way. Two of the rollers guides are secured to the upper portion of the elevator car in such a manner as to engage the corresponding guide rails. The remaining two roller guides are secured to the lower portion of the elevator car in a similar manner to engage the corresponding guide rails.

Over time, guide rails are subjected to various forces that can deform one of more portions of the guide rail or buckle joints that hold sections of the guide rail together. This results in misalignment of one or more sections or portions of the guide rail. Such destructive forces include high winds which can cause some high-rise buildings to sway as much as eighteen inches off center for a total swing of three feet. Over time, this wind load and the resulting sway of the building may cause rails to misalign due to the constant flexing of the guide rail. Misalignment of portions or sections of the guide rails can also result from settling of the building. Further, elevator cars can become out of balance when the elevator car is structurally modified to improve its aesthetic appearance or for other commonly known reasons. Misalignment of various sections or portions of the guide rails and/or an out of balance elevator car can drastically affect the ride quality of the elevator car as it travels in a shaft or hoistway.

Various roller guide designs have been proposed in an attempt to address some or all of these adverse conditions. However, the prior designs have various inherent disadvantages and/or are unable to adequately compensate for all adverse conditions an elevator car and/or the guide rails may experience over prolonged use.

OBJECTS AND SUMMARY OF THE INVENTION

An object of the preferred embodiment of the present invention is to provide a novel and unobvious roller guide.

Another object of a preferred embodiment of the present invention is to provide a roller guide that overcomes one or more disadvantages of previously known roller guides.

A further object of a preferred embodiment of the present invention is to provide a roller guide that reduces vibration and/or noise to improve the ride characteristics of the elevator car.

Still a further object of a preferred embodiment of the present invention is to reduce and/or compensate for the amplitude of vibrations introduced by hoistway conditions over time.

Yet still another object of a preferred embodiment of the present invention is to provide a roller guide that improves overall ride quality and yet can still be readily manufactured by relatively inexperienced labor.

Yet another object of a preferred embodiment of the present invention is to provide a roller guide that can readily compensate for the adverse affects on the shaft or hoistway resulting from wind force and/or settling of the building.

Still another object of a preferred embodiment of the present invention is to provide a roller guide that can readily compensate for an elevator car that becomes out of balance for various reasons including subsequent structural modifications.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one embodiment of the present invention is directed to an elevator roller guide including a base, a first roller and a first support arm. The first support arm includes a first lower leg and a second lower leg. The first lower leg is spaced from the second lower leg. The first support arm is pivotally connected to the base adjacent the first and second lower legs. The first roller is rotatably connected to the first support arm at a position removed from the first and second lower legs. An isolation member is provided for isolating an elevator car from the first roller and the first support arm to minimize undesired forces translated to the elevator car through the first roller, the first support arm and the base. The isolation member is positioned intermediate the first lower leg and the second lower leg of the first support arm.

Another embodiment of the present invention is directed to an elevator roller guide having a base, a first roller and a first support arm. The first support arm is pivotally connected to the base. The first support arm includes a first upper leg and a second upper leg. The first upper leg is spaced from the second upper leg. The first roller is rotatably connected to the first support arm between the first upper leg and the second upper leg. The first upper leg extends upwardly above the second upper leg. A flange portion extends outwardly from a section of the first leg that is disposed above the second upper leg. The flange has first and second openings for receiving first and second shafts. One of the first and second shafts has a spring mounted thereon and the other of said first and second, shafts has a stop member mounted thereon to limit movement of the first support arm.

A further embodiment of the present invention is directed to an elevator roller guide having a base, a first roller and a first support arm. The first support arm is pivotally connected to the base such that the first support arm can move relative to the base. The first roller is rotatably connected to the first support arm. The roller guide further includes an isolation member for isolating an elevator car from the first roller and the first support arm to minimize undesired forces translated to the elevator car through the first roller, the first support arm and the base. The isolation member includes a first annular member fixed to the base such that the first annular member does not move relative to the base. The isolation member includes a second annular member operably connected to the first support arm such that the second annular member moves with the first support arm. The isolation member further includes an elastomeric member positioned between the first annular member and the second annular member.

Still another embodiment of the present invention is directed to an elevator roller guide including a base, a first roller and a first support arm. The first support arm is pivotally connected to the base such that the support arm can move relative to the base. The first roller is rotatably connected to the first support arm. The first support arm includes a first face. The first face includes an embossment. The roller guide further includes an isolation member for isolating an elevator car from the first roller and the first support arm to minimize undesired forces translated to the elevator car through the first roller, the first support arm and the base. The isolation member is positioned adjacent the embossment to prevent undesired movement of the first support arm relative to the base.

Yet another embodiment of the present invention is directed to an elevator roller guide having a base, a first roller and a first support arm. The first support arm is pivotally connected to the base such that the support arm can move relative to the base. The first roller is rotatably connected to the first support arm. The first support arm includes at least one leg extending in a first vertical plane. The roller guide further includes an elastomeric member for isolating an elevator car from the first roller and the first support arm to minimize undesired forces translated to the elevator car through the first roller, the first support arm and the base. The elastomeric member is positioned such that the first vertical plane passes through at least a portion of the elastomeric member.

DETAILED DESCRIPTION OF THE PREFERRED EMBODIMENTS OF THE INVENTION

The most preferred forms of the invention will now be described with reference to FIGS. 1-6. The appended claims are not limited to the most preferred forms and no term used herein is to be given a meaning other than its ordinary meaning unless accompanied by a statement that the term "as used herein is defined as follows".

Figure 1:
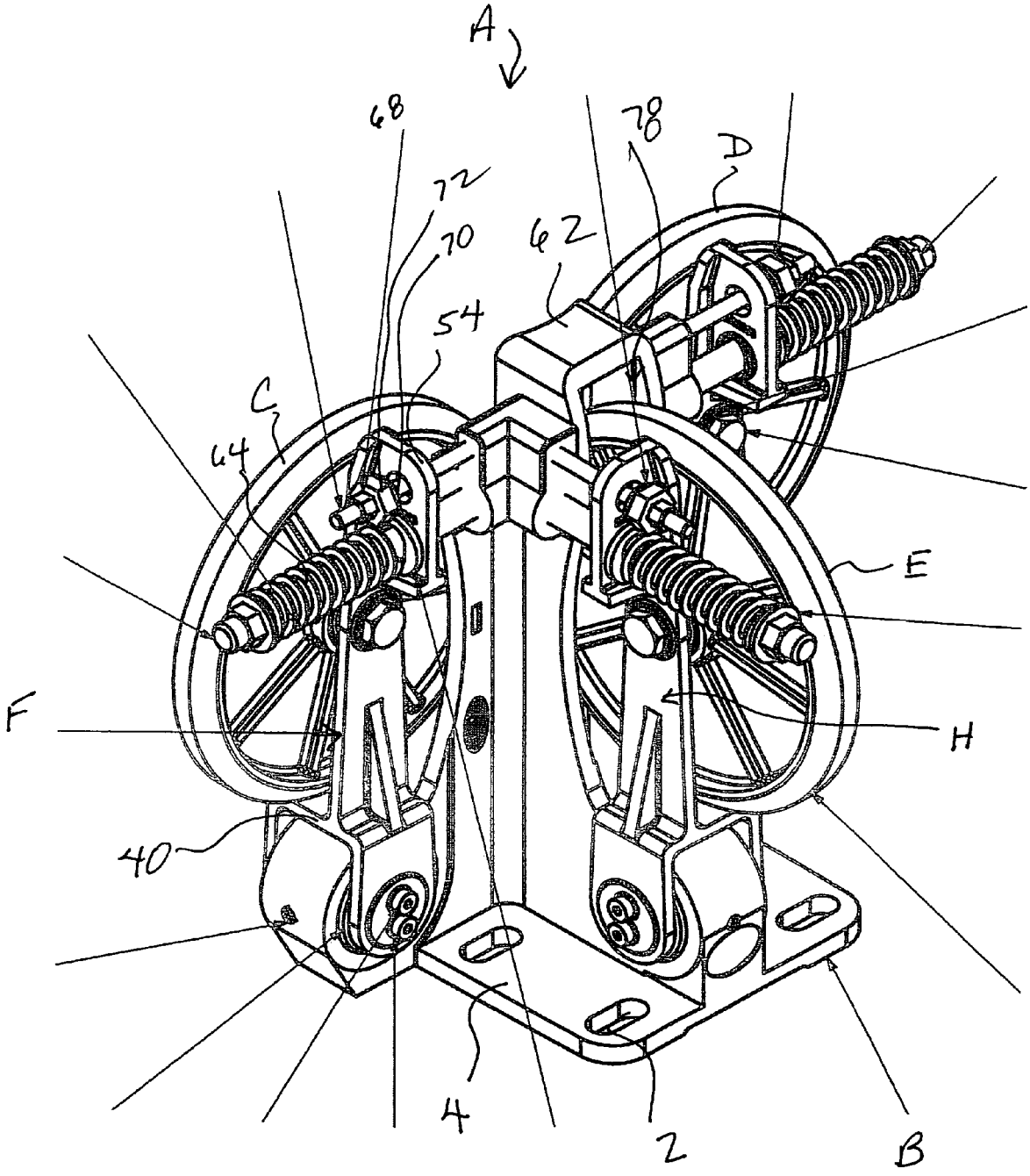
FIG. 1 is a perspective view of a roller guide formed in accordance with the most preferred embodiment of the present invention.
Figure 2:
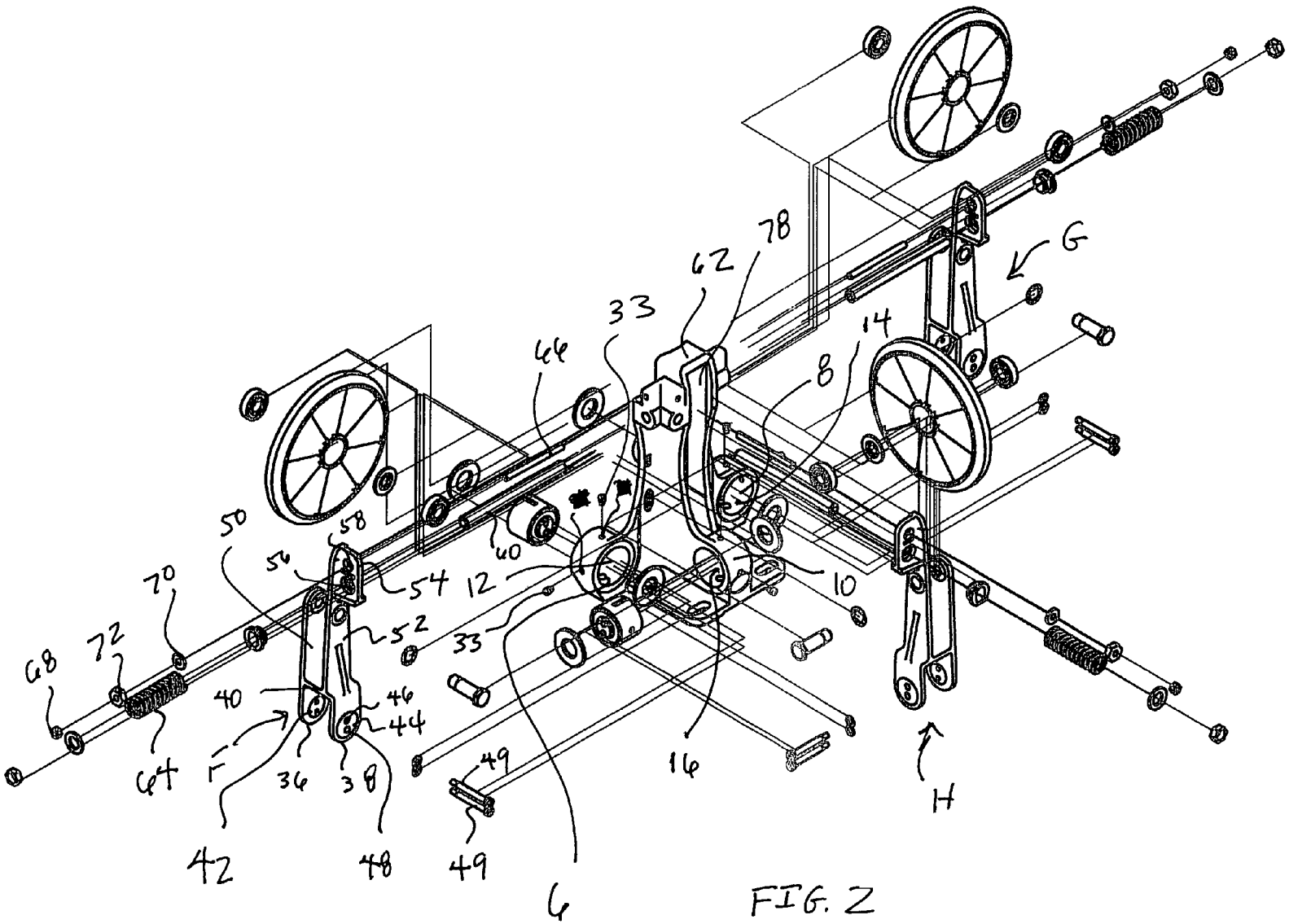
FIG. 2 is an exploded view of the roller guide depicted in FIG. 1.
Figure 3:
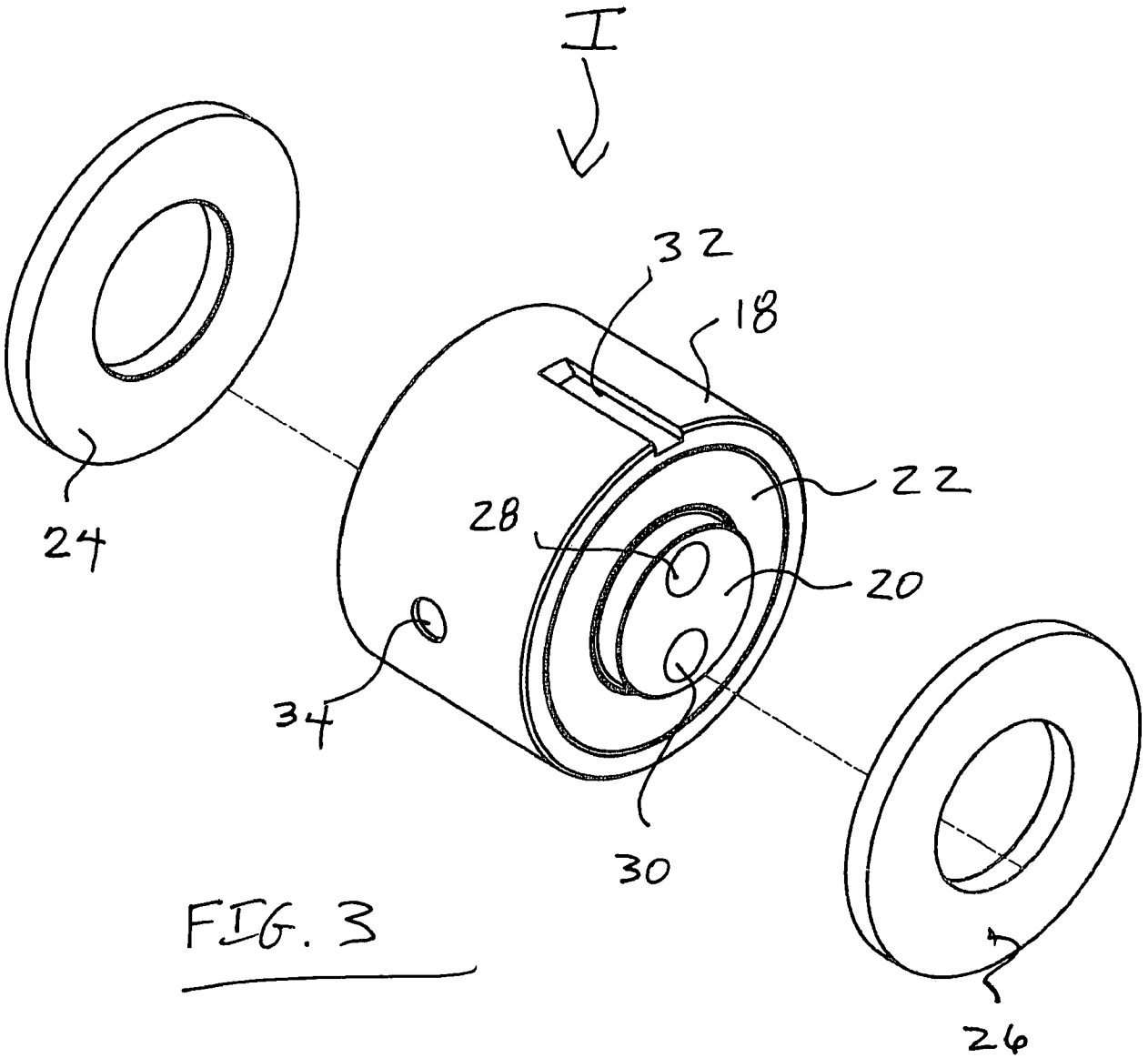
FIG. 3 is a partially exploded view of an isolation assembly formed in accordance with one preferred form of the present invention.

FIGS. 1 Through 3

Referring to FIGS. 1 to 3, a roller guide A is illustrated in one of many possible configurations. The roller guide A includes a base B and rollers C, D and E. The roller guide A further includes support arms F, G and H and an isolation assembly I. It will be readily appreciated by one of ordinary skill in the art that the number of rollers and support arms may be varied as desired. Further, it will be readily appreciated by one of ordinary skill in the art that all components of the roller guide A may be formed from any suitable material.

Typically, four roller guides A are utilized for each elevator car (not shown). The base B of the roller guides A are mounted to the elevator car via conventional fasteners passing through openings 2 formed in the lower portion 4 of the base B. The rollers C, D and E of the roller guides A engage a corresponding guide rail (not shown) to guide the movement of the elevator car in a shaft or hoistway. The roller guides A will now be described in greater detail.

Referring to FIG. 2, the base B includes three mounting collars 6,8, and 10 each of which extend upwardly form the lower portion 4. Mounting collars 6,8, and 10 include enlarged openings 12,14 and 16 for receiving the isolation assembly I. Referring to FIG. 3, the isolation assembly I includes an outer annular member 18, an inner member 20, an elastomeric member 22 and end plates 24 and 26. The inner member 20 includes a pair of openings 28 and 30. Referring to FIGS. 1 to 3, the outer annular member 18 includes a keyway 32 and two or more recesses 34 (only one of which is shown) to receive set screws 33 or other suitable fasteners to fix outer annular member 18 to the base B such that outer annular member 18 does not move relative to the base B. As is seen in FIG. 2, set screws 33 pass through openings 35 formed in the mounting collar 6.

The outer surface of elastomeric member 22 is bonded to the inner surface of the outer annular member 18. The inner surface of elastomeric member 22 is bonded to the outer surface of inner member 20. It will be readily appreciated that any suitable bonding agent may be used to secure the elastomeric element 22 to the inner member 20 and outer member 18.

Support arms F, G and H are identical in configuration and the manner of mounting to base B. Therefore, only one of the support arms and the manner of mounting the same to base B will be described in detail. Referring to FIGS. 1 and 2, support arm F includes lower legs 36 and 38 that extend downwardly from the horizontally extending segment 40. The inner surfaces of lower legs 36 and 38 each include an embossment 42 while each of the outer surfaces of lower legs 36 and 38 have an embossment 44. The embossments 42 are disposed directly adjacent the end plates 24 and 26 of the isolation assembly I to prevent undesired movement of the support arm F, particularly rotational movement in a vertical plane extending perpendicular to roller C. Openings 46 and 48 are formed in each of the lower legs 36 and 38. The openings 46 and 48 are aligned with openings 28 and 30 to permit the support arm F to be pivotally connected to the base B via a pair of conventional fasteners 49. This pivotal connection allows the support arm F to rock back and forth as needed to compensate for misaligned sections or portions of the guide rail among other conditions. Embossments 44 facilitate the pivotal connection of support arm F to base B.

The use of two fasteners 49 passing through the inner member 20 and the lower legs 36 and 38 results in the inner member 20 moving with the support arm F. While the inner member 20 moves with the support arm F, the outer annular member 18 remains fixed to the base B. This arrangement of components of the roller guide A allows the elastomeric member 22 to isolate the base B from the support arm F and the roller C to minimize the transmission of undesired forces (e.g., noise and vibration) to the elevator car through the roller C, support arm F and the base B. This arrangement also permits the elastomeric member 22 to dampen vibration.

Referring to FIGS. 1 and 2, the support arm F further includes a pair of upper legs 50 and 52. Upper leg 52 extends above the upper leg 50. Flange 54 extends outwardly from the section of upper leg 52 disposed above upper leg 50. Flange 54 has openings 56 and 58 formed therein. Opening 56 receives shaft 60. Shaft 60 is embedded in tower 62 of base B and extends outwardly therefrom. A spring 64 is mounted on shaft 60 between the outermost end of shaft 60 and flange 54. The spring 64 is held in this position by conventional hardware. Opening 58 in flange 54 receives shaft 66. Shaft 66 is embedded in tower 62 and extends parallel to shaft 60. A nut 68, a washer 70 and an enlarged annular member 72 are mounted on the outermost end of shaft 66 to act as a stop to limit the movement of the roller C away from the corresponding guide rail. As seen in FIG. 1, tower 62 has an enlarged opening 78 for receiving roller E.

Figure 5:
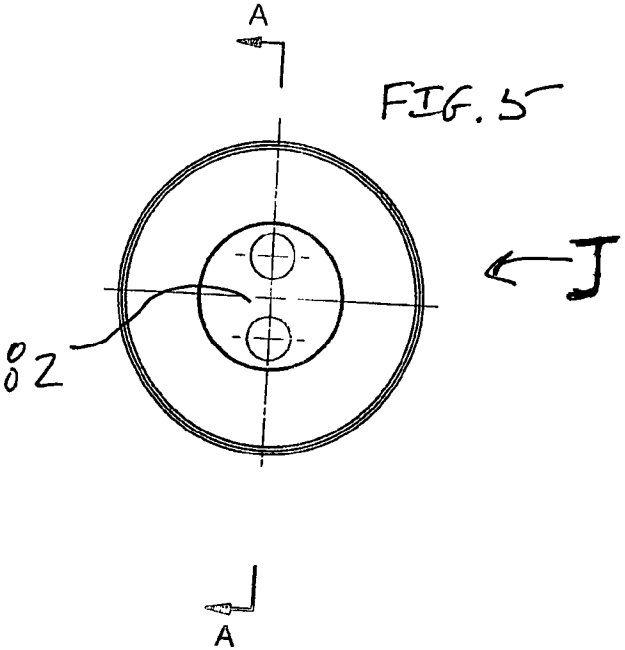
FIG. 5 is a side view of the isolation assembly depicted in FIG. 4.
Figure 6:
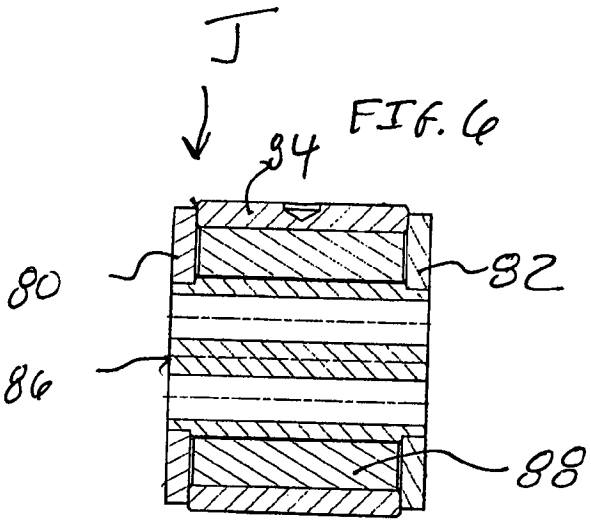
FIG. 6 is a cross-sectional view taken along lines A-A in FIG. 5.
Figure 4:
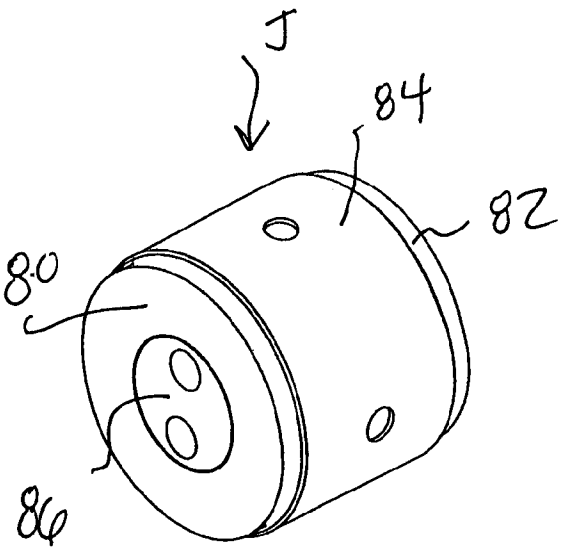
FIG. 4 is a perspective view of an isolation assembly formed in accordance with another preferred form of the present invention.

Referring to FIGS. 4 to 6, an alternative isolation assembly J will now be described. The isolation assembly J includes end plates 80 and 82, outer annular member 84, inner member 86 and elastomeric member 88. The sole difference between isolation assembly J and isolation assembly I is that the keyway of isolation assembly I has been omitted from the isolation assembly J.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. An elevator roller guide, comprising:

(a) a base, a first roller and a first support arm;

(b) said first support arm includes a first lower leg and a second lower leg, said first lower leg being spaced from said second lower leg, said first support arm being pivotally connected to said base adjacent said first and second lower legs, said first roller being rotatably connected to said first support arm at a position removed from said first and second lower legs; and, (c) an isolation member for isolating an elevator car from said first roller and said first support arm to minimize undesired forces translated to the elevator car through said first roller, said first support arm and said base, said isolation member being positioned intermediate said first lower leg and said second lower leg of said first support arm.

2. An elevator roller guide as set forth in claim 1, wherein:

(a) at least one of said first and second lower legs includes an embossment, said isolation member being positioned directly adjacent said embossment to prevent undesired movement of said first support arm.

3. An elevator roller guide as set forth in claim 1, wherein:

(a) said first and second lower legs each include an embossment; and (b) said isolation member includes first and second ends, said first end being positioned directly adjacent said embossment on said first lower leg and said second end being positioned directly adjacent said embossment on said second lower leg to prevent undesired movement of said first support arm.

4. An elevator roller guide as set forth in claim 3, wherein:

(a) said first support arm includes a first upper leg and a second upper leg, said first roller is positioned between said first and second upper legs.

5. An elevator roller guide as set forth in claim 4, wherein:

(a) said first upper leg extends upwardly above said second upper leg, a flange portion extends outwardly from a section of said first upper leg that extends above said second upper leg, said flange includes first and second openings for receiving first and second shafts, one of said first shaft and said second shaft has a spring mounted thereon and the other said first shaft and said second shaft have a stop member mounted thereon to limit movement of said first support arm.

6. An elevator roller guide as set forth in claim 1, wherein:

(a) said isolation member has a first annular member fixed to said base, said isolation member has a second annular member operably connected to said first support arm such that said second annular member moves with said first support arm, said isolation member further includes an elastomeric member positioned between said first annular member and said second annular member.

7. An elevator roller guide as set forth in claim 1, wherein:

(a) a first portion of said base extends upwardly between said first lower leg and said second lower leg of said first support arm, said first portion having an opening extending therethrough, said isolation member being disposed in said opening.

8. An elevator roller guide, comprising:

(a) a base, a first roller and a first support arm;

(b) said first support arm being pivotally connected to said base, said first support arm including a first upper leg and a second upper leg, said first upper leg being spaced from said second upper leg, and first roller being rotatably connected to said first support arm between said first upper leg and said second upper leg; and, (c) said first upper leg extends upwardly above said second upper leg, a flange portion extends outwardly from a section of said first leg that is disposed above said second upper leg, said flange having first and second openings for receiving first and second shafts, one of said first and second shafts having a spring mounted thereon and the other of said first and second shafts having a stop member mounted thereon to limit movement of said first support arm.

9. An elevator roller guide as set forth in claim 8, further including:

(a) an isolation member for isolating an elevator car from said first roller and said support arm to minimize undesired forces translated to the elevator car through said first roller, said first support arm and said base.

10. An elevator roller guide as set forth in claim 9, wherein:

(a) said first support arm includes a first lower leg and a second lower leg, said first lower leg is spaced from said second lower leg, said isolation member is positioned between said first lower leg and said second lower leg.

11. An elevator roller guide as set forth in claim 10, wherein:

(a) said isolation member has a first annular member fixed to said base such that said first annular member does not move relative to said base, said isolation member includes a second annular member operably connected to said first support arm such that said second annular member moves with said first support arm.

12. An elevator roller guide, comprising:

(a) a base, a first roller and a first support arm;

(b) said first support arm being pivotally connected to said base such that said first support arm can move relative to said base, said first roller being rotatably connected to said first support arm; and, (c) an isolation member for isolating an elevator car from said first roller and said first support arm to minimize undesired forces translated to the elevator car through said first roller, said first support arm and said base, said isolation member having a first member fixed to said base such that said first member does not move relative to said base, said first member being annular, said isolation member including a second member operably connected to said first support arm such that said second member moves with said first support arm, said second member having at least one opening extending therethrough, said isolation member further including an elastomeric member positioned between said first member and said second member.

13. An elevator roller guide as set forth in claim 12, wherein:

(a) said isolation member includes a first end plate and a second end plate, said first end plate extends substantially parallel to said second end plate, said elastomeric member being positioned between said first end plate and said second end plate.

14. An elevator roller guide as set forth in claim 13, wherein:

(a) said first support arm includes a first lower leg and a second lower leg, said first lower leg being spaced from said second lower leg, said isolation member is positioned between said first lower leg and said second lower leg.

15. An elevator roller guide as set forth in claim 14, wherein:

(a) said first lower leg and said second lower leg each have an embossment, said embossment of said lower leg is positioned adjacent said first end plate of said isolation member and said embossment of said second lower leg is positioned adjacent said second end plate of said isolation member to prevent undesired movement of said first support arm.

16. An elevator roller guide comprising:

(a) a base, a first roller and a first support arm;

(b) said first support arm being pivotally connected to said base such that said first support arm can move relative to said base, said first roller being rotatably connected to said first support arm;

(c) an isolation member for isolating an elevator car from said first roller and said first support arm to minimize undesired forces translated to the elevator car through said first roller, said first support arm and said base, said isolation member having a first annular member fixed to said base such that said first annular member does not move relative to said base, said isolation member including a second annular member operably connected to said first support arm such that said second annular member moves with said first support arm, said isolation member further including an elastomeric member positioned between said first annular member and said second annular member; and, (d) said second annular member having a pair of openings extending therethrough.

17. An elevator roller guide as set forth in claim 16, wherein:

(a) said first support arm further includes a first lower leg, a second lower leg, a first upper leg and a second upper leg, said first roller is positioned between said first upper leg and said second upper leg, said elastomeric member is positioned between said first lower leg and said second lower leg of said first support arm.

18. An elevator roller guide, comprising:

(a) a base, a first roller and a first support arm;

(b) said first support arm being pivotally connected to said base such that said support arm can move relative to said base, said first roller being rotatably connected to said first support arm, said first support arm having a first face, said first face including an embossment; and, (c) an isolation member for isolating an elevator car from said first roller and said first support arm to minimize undesired forces translated to the elevator car through said first roller, said first support arm and said base, said isolation member being positioned adjacent said embossment to prevent undesired movement of said first support arm relative to said base.

19. An elevator roller guide as set forth in claim 18, wherein:

(a) said isolation member has a first annular member fixed to said base such that said first annular member does not move relative to said base, said isolation member has a second annular member operably connected to said first support arm such that said second annular member moves with said first support arm, said isolation member includes an elastomeric member positioned between said first annular member and said second annular member, said isolation member further includes a first end plate and a second end plate, said first end plate extends substantially parallel to said second end plate, said elastomeric member is positioned between said first end plate and said second end plate; and, (b) said embossment on said first face of said first support arm is positioned directly adjacent said first end plate of said isolation member to prevent undesired movement of said first support arm.

20. An elevator roller guide, comprising:

(a) a base, a first roller and a first support arm;

(b) said first support arm being pivotally connected to said base such that said support arm can move relative to said base, said first roller being rotatably connected to said first support arm, said first support arm including an upper leg and first and second lower legs, said upper leg being offset from said first and second lower legs; and, (c) an elastomeric member for isolating an elevator car from said first roller and said first support arm to minimize undesired forces translated to the elevator car through said first roller, said first support arm and said base said elastomeric member positioned intermediate said first lower leg and said second lower leg of said first support arm.

21. An elevator roller guide as set forth in claim 20, wherein:

(a) said first lower leg being spaced from said second lower leg, said elastomeric member is positioned between said first lower leg and said second lower leg of said first support arm.

* * * * *

UNITED STATES PATENT AND TRADEMARK OFFICE

CERTIFICATE OF CORRECTION

PATENT NO. : 7,562,749 B2 
APPLICATION NO. : 10/837608
DATED : July 21, 2009
INVENTOR(S) : Timothy Theodore Race, Sr., Richard Alan Ruskey and William Paul Sturm, III It is certified that error appears in the above-identified patent and that said Letters Patent is hereby corrected as shown below:

Col. 8, Claim 20, line 44, "member positioned" should be -- member being positioned --

Signed and Sealed this

First Day of September, 2009

David J. Kappos

David J. Kappos
*Director of the United States Patent and Trademark Office*